US012571071B2

(12) United States Patent
Zhang et al.

(10) Patent No.: US 12,571,071 B2
(45) Date of Patent: Mar. 10, 2026

(54) METHOD FOR RECOVERING RARE-EARTH IN CERIUM-BASED RARE-EARTH POLISHING POWDER WASTE BY TWO-STEP ACID LEACHING GRADIENT SEPARATION

(71) Applicant: BEIJING UNIVERSITY OF TECHNOLOGY, Beijing (CN)

(72) Inventors: Qijun Zhang, Beijing (CN); Yufeng Wu, Beijing (CN); Minwei Song, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 513 days.

(21) Appl. No.: 18/132,979

(22) Filed: Apr. 11, 2023

(65) Prior Publication Data

US 2023/0265541 A1 Aug. 24, 2023

Related U.S. Application Data

(63) Continuation of application No. PCT/CN2021/132407, filed on Nov. 23, 2021.

(30) Foreign Application Priority Data

Dec. 2, 2020 (CN) ..... 202011395568.X

(51) Int. Cl.

| | |
|---|---|
| ***C22B 59/00*** | (2006.01) |
| ***C22B 1/24*** | (2006.01) |
| ***C22B 7/00*** | (2006.01) |

(52) U.S. Cl.

CPC ..... *C22B 59/00* (2013.01); *C22B 1/24* (2013.01); *C22B 7/001* (2013.01); *C22B 7/007* (2013.01)

(58) Field of Classification Search

None

See application file for complete search history.

(56) References Cited

U.S. PATENT DOCUMENTS

2020/0080169 A1 3/2020 Nockemann

FOREIGN PATENT DOCUMENTS

| | | |
|---|---|---|
| CA | 2631190 A1 | 11/2009 |
| CN | 1456624 A | 11/2003 |

(Continued)

OTHER PUBLICATIONS

English translation of CN-107012333-A Description. (Year: 2017).*

(Continued)

*Primary Examiner* — Anthony J Zimmer
*Assistant Examiner* — Zachary John Baum
(74) *Attorney, Agent, or Firm* — J.C. PATENTS

(57) ABSTRACT

The invention relates to a method of recovering rare-earth in cerium-based rare-earth polishing powder waste by two-step acid leaching gradient separation, characterized by: firstly, using a one-step acid leaching treatment on cerium-based rare-earth polishing powder waste to obtain a rare-earth leaching liquor which is rich in La; secondly, the leaching residue is then processed through alkali activation and transformation process, water washing and impurity removal process, secondary acid leaching process, filtration, and recovery to obtain high purity $CeO_2$ products; thirdly, the acid leaching liquor obtained through first acid leaching and second acid leaching process is finally precipitated by oxalic acid, filtered and calcined at high temperature to obtain rare-earth oxide mixed products, which achieves the gradient separation and recovery of rare-earths from cerium-based rare-earth polishing powder waste. The total recovery efficiency of rare-earth of this invention reaches 97% or (Continued)

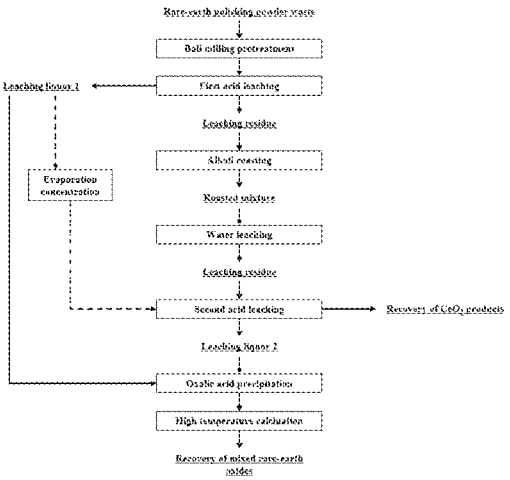

higher, with high efficiency of rare-earth recovery, wide process applicability, and low environmental pollution.

4 Claims, 1 Drawing Sheet

(56) References Cited

FOREIGN PATENT DOCUMENTS

| | | | | | |
|---|---|---|---|---|---|
| CN | 103103361 | A | | 5/2013 | |
| CN | 104232947 | A | | 12/2014 | |
| CN | 104946895 | A | | 9/2015 | |
| CN | 105039698 | A | | 11/2015 | |
| CN | 105985735 | A | | 10/2016 | |
| CN | 106967891 | A | | 7/2017 | |
| CN | 107012333 | A | * | 8/2017 | ..... C22B 59/00 |
| CN | 108929957 | A | | 12/2018 | |
| CN | 109055783 | A | | 12/2018 | |
| CN | 109207737 | A | | 1/2019 | |
| CN | 109534472 | A | * | 3/2019 | ..... C02F 1/56 |
| CN | 111471865 | A | | 7/2020 | |
| CN | 111762818 | A | * | 10/2020 | ..... C01B 33/18 |
| CN | 112725622 | A | | 4/2021 | |
| JP | H11319755 | A | | 11/1999 | |
| KR | 20040055219 | A | | 6/2004 | |
| WO | WO0047785 | | | 8/2000 | |

OTHER PUBLICATIONS

English translation of CN-109534472-A Description. (Year: 2019).*
English translation of CN-111762818-A Description. (Year: 2020).*
English translation of CN-103103361-A Description. (Year: 2013).*
International Search Report for PCT/CN2021/132407.
First Search Report of the priority application CN202011395568.X.
Second Search Report of the priority application CN202011395568.X.

* cited by examiner

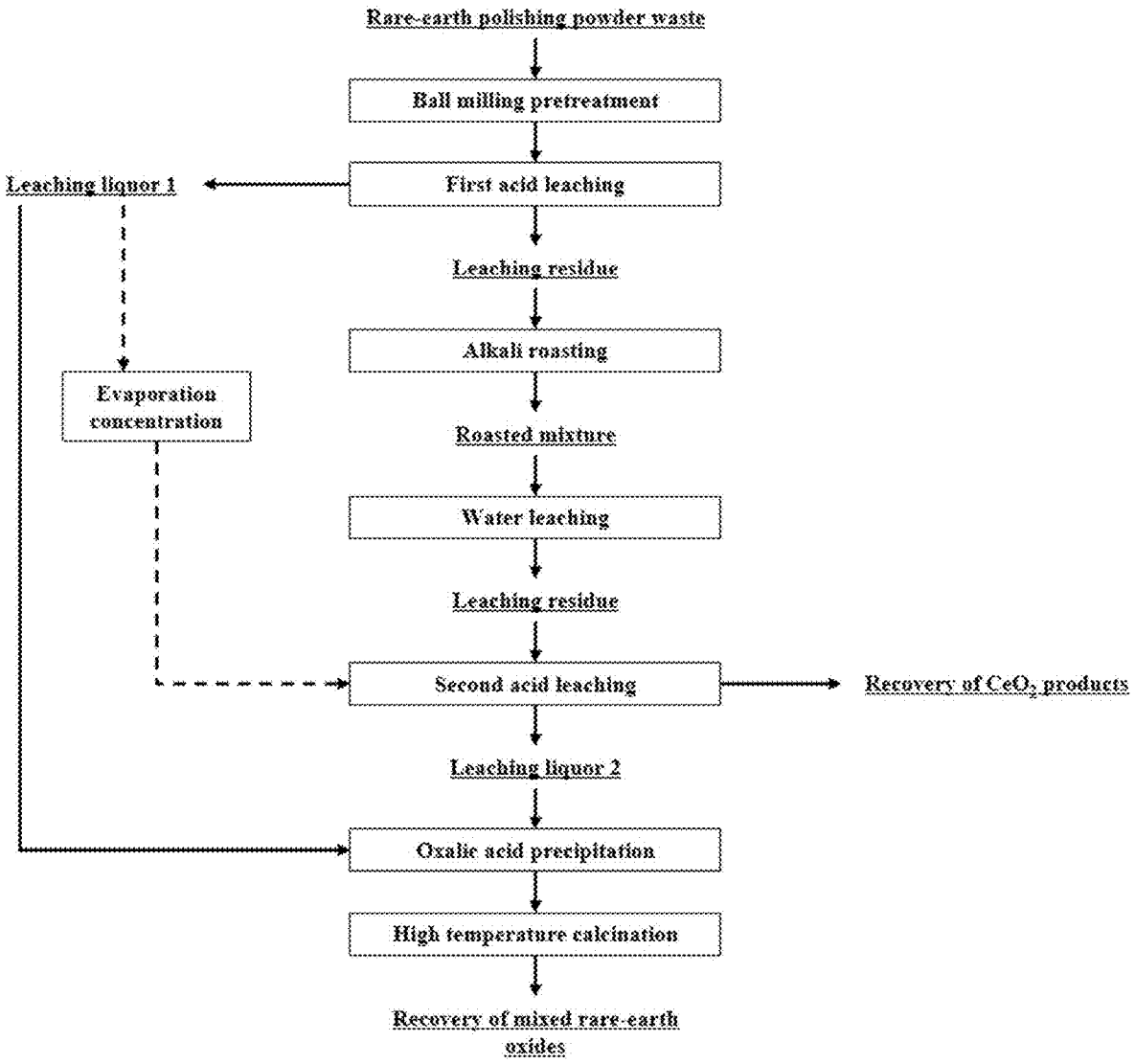
Rare-earth polishing powder waste
Ball milling pretreatment
First acid leaching
Leaching liquor 1
Leaching residue
Alkali roasting
Evaporation concentration
Roasted mixture
Water leaching
Leaching residue
Second acid leaching
Recovery of $CeO_2$ products
Leaching liquor 2
Oxalic acid precipitation
High temperature calcination
Recovery of mixed rare-earth oxides

METHOD FOR RECOVERING RARE-EARTH IN CERIUM-BASED RARE-EARTH POLISHING POWDER WASTE BY TWO-STEP ACID LEACHING GRADIENT SEPARATION

CROSS-REFERENCE TO RELATED APPLICATIONS

This application is a continuation of International Application No. PCT/CN2021/132407, filed on Nov. 23, 2021, which claims priority to Chinese Patent Application No. 202011395568.X, filed on Dec. 2, 2020, both of which are hereby incorporated by reference in their entireties.

TECHNICAL FIELD

The invention is a method to recover rare-earth from cerium-based polishing powder waste, in particular, a method for separating and recovering rare-earth in cerium-based rare-earth polishing powder waste by two-step acid leaching gradient separation.

BACKGROUND ART

In recent years, with the rapid development of optical engineering and electronic information technology, especially with the rapid development of touch screen and LCD industries, the requirements for surface quality and processing accuracy are getting more and more stringent, which has increased the demand for high-quality polishing powder. Cerium-based rare-earth polishing powder is known as the "king of polishing powder" for its uniform particle size, moderate hardness, high polishing precision, high burnishing rate, low scratch rate, long service life, and the characteristics of clean and environmental-friendly, and has become the most widely used polishing powder. The large-scale application of cerium-based rare-earth polishing powder has led to a sharp increase in the production of cerium-based rare-earth polishing powder waste. According to statistics, the annual production of waste cerium-based rare-earth polishing powder in China exceeds 100,000 tons. The cerium-based rare-earth polishing powder waste mainly contains rare-earth elements (La and Ce), and the rare-earth oxide percentage content is 15% to 60%. In addition, it also contains the polished glass particles, the grinding belt particles (organic polymer) of the polishing machine, the precipitant of aluminum chloride, and other impurities. Traditionally, cerium-based rare-earth polishing powder waste is disposed by stacking or landfill, which not only occupies land resources, but also causes a great waste of strategic resources of rare-earth. Therefore, the recycling of cerium-based rare-earth polishing powder waste can not only bring economic benefits, but also save land resources and primary rare-earth mineral resources. To conclude, promoting and upgrading the recycling process has major economic, social, and environmental benefits.

Chinese patent CN 111471865 A introduces a recovery method of rare-earth polishing powder waste. According to the patent, firstly, the rare-earth elements in the cerium-based rare-earth polishing powder waste are leached by using strong acid multistage countercurrent leaching process. Secondly, the rare-earth leaching solution is extracted and stripped repeatedly to obtain high-purity rare-earth chloride solution. Thirdly, the obtained rare-earth chloride solution is mixed with the surface active agent and ammonium bicarbonate to obtain rare-earth carbonate. And the final stage is to mix the rare-earth carbonate with fluoride, and roast the mixture to obtain rare-earth polishing powder with high-performance. However, as this method only involves strong acid leaching, when the cerium-based polishing powder waste has a high percentage of $CeO_2$ content or has structures that is insoluble in acid, such as $LaF_3$, LaOF, $LaF_2$ or $CeF_3 \cdot La_2O_3$, the process would underperform for its low efficiency, poor process universality and other shortcomings.

Chinese patent CN 103103361 A publishes a method to recover rare-earth oxide from the rare-earth polishing powder waste. The method includes the following procedure: first, pretreat the rare earth polishing powder waste by alkali roasting. Secondly, and the product goes through the water leaching, acid leaching, washing, oxalic acid precipitation and high temperature calcination by sequence to obtain rare-earth oxide products. The advantage of the method is that $LaF_3$, LaOF and $CeO_2$ in the cerium-based rare-earth polishing powder waste, which are insoluble in acid, can be decomposed through high-temperature alkali roasting and promote the leaching efficiency in the following acid leaching process, and improve the recovery efficiency over 90%. However, the method needs relatively large amount of alkali, and thus lead to a high recovery cost; and the recovery efficiency can also be further improved.

Chinese patent CN03119524.5 and Japanese patent JPH11319755A carry out cerium-based rare-earth polishing powder waste pretreatment with water-soluble fluoride or hydrofluoric acid, so as to remove impurities and recover the rare-earth elements. But these methods are not only complicated in process, but also generate large amount of waste liquor with fluorine, which leads to difficulties in subsequent fluoride treatment and might cause environmental pollution problems.

Therefore, inventing a method for recovering rare-earth in cerium-based rare-earth polishing powder waste with simple process, high process universality, high rare-earth recovery efficiency and little pollution is of great significance to the recycling and utilization of rare-earth secondary resources.

DETAILED DESCRIPTION

The object of the invention targets to the deficits of the existing cerium-based rare-earth polishing powder waste recovery methods and aims to provide a cerium-based rare-earth polishing powder waste recovery method that requires no hydrofluoric acid or water-soluble fluoride for the recovering, but applies a two-step process of, firstly, a combination of acid leaching and alkali roasting, and secondly, secondary acid leaching. The method of the invention is of advantages for its simple process, high rare-earth recovery efficiency, wide process universality, and little pollution.

The two-step process of separation and recovery of rare-earth in cerium-based rare-earth polishing powder waste described in the present invention comprises the following steps:

(1) Ball milling pretreatment: the cerium-based rare-earth polishing powder waste is ball-milled to a particle size below 160 mesh to obtain ball-milled waste;

(2) First acid leaching: put the ball milled waste obtained in step (1) into a container and add an acid solution for the first acid leaching. Keep heating and stirring during the first acid leaching process. Separate the solid and the liquid after the first acid leaching reaction to obtain leaching residue and leaching liquor 1. The molar concentration of the acid solution is 5-8 mol/L, the solid-liquid ratio of ball milling waste and acid solution is 1 kg:4-8 L, the leaching temperature is 70-80° C., and the leaching time is 1-2 hours;

(3) Alkali roasting: mix the leaching residue obtained in step (2) with alkali and roast the mixture to obtain roasted mixture. The mass ratio of leaching residue and alkali is 1:1-1:3, the roasting temperature is 450-650° C., and the roasting time is 0.5-1.5 hours;

(4) Water leaching: put the roasted mixture obtained in step (3) in water. The solid-liquid ratio of the roasted mixture to water is 1 kg:4-9 L, the water leaching temperature is 80-90° C., the water leaching time is 2-3 hours, and the stirring speed is 300-500 rpm. After the water leaching, separate the solid from the liquid, and the water leaching residue is obtained by filtration;

(5) Second acid leaching: mix the water leaching residue obtained in step (4) with acid solution to carry out secondary acid leaching reaction. Separate the solid from the liquid after the second acid leaching, and filter to obtain $CeO_2$ product and leaching liquor 2. The molar concentration of the acid solution is 5-8 mol/L, the solid-liquid ratio of the water leaching residue and the acid solution is 1:2.5-1:6 kg/L, the leaching temperature is 70-80° C., and the leaching time is 2-3 hours;

(6) Precipitation of rare-earths with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 5:1-3:1. Stir and add ammonia whose mass percentage concentration ratio is 25%, until the pH value of the solution reaches 1.8-2.0, and precipitate at 80-90° C. for 2-3 hours. Filtrate to obtain rare-earth oxalate;

(7) Calcination: the rare-earth oxalate obtained in step (6) is calcined in a muffle furnace at 950° C. for 0.5-1 hour to obtain rare-earth oxide product.

In step (2), the acid solution used is hydrochloric acid solution or nitric acid solution.

In step (2), the stirring speed is 300-500 rpm.

In step (3), the alkali used in the alkali roasting process is $Na_2O_2$ or $K_2O_2$.

In step (5), the acid solution used is hydrochloric acid solution or nitric acid solution.

In step (5), the stirring speed is 300-500 rpm.

In step (5), when the solid is separated from the liquid after the secondary acid leaching reaction, the $CeO_2$ product obtained is washed 4-8 times with hydrochloric acid solution to remove impurities. The mass concentration of hydrochloric acid solution is 2-5%.

The leaching liquor 1 obtained in step (2) is evaporated and concentrated till the molar concentration of HCl or HNO reaches 5-8 mol/L. The concentrated leaching liquor 1 can be then incorporated into the secondary acid leaching process of step (5) to partially or completely replace hydrochloric acid solution or nitric acid solution.

Compared with the existing rare-earth recovery process for cerium-based rare-earth polishing powder waste, the process of the invention includes the following steps. Firstly, first acid leaching. The cerium-based rare-earth polishing powder waste are leached in acid solution to obtain $La_2O_3$ components efficiently. Secondly, alkali roasting. The leaching residue are roasted with alkali, so that the $LaOF_2$, $LaF_3$, $LaF_2$ or $CeF_3 \cdot La_2O_3$ components in the residue, which are insoluble in acid, undergo mineral phase changes and structure transformation, and the components with Al and Si are transformed into water-soluble substances. Thirdly, water leaching, and fourthly, secondary acid leaching. The $CeO_2$ product can be selectively separated and recovered during these two steps. Finally, the rare-earth elements in the rare-earth filtrate obtained in the first acid leaching and secondary acid leaching steps can be separated and recovered by oxalic acid precipitation, and the rare-earth in the cerium-based rare-earth polishing powder waste is recovered in two stages. The total recovery efficiency of rare-earth elements in the cerium-based rare-earth polishing powder waste of the invention reaches more than 97%. Comparing to the existing processes, the invention has higher rare-earth recovery efficiency, wider process universality, and generates less pollution.

BRIEF DESCRIPTION OF THE DRAWINGS

FIG. 1 is a flow chart of the method for separating and recovering rare-earth from cerium-based rare-earth polishing powder waste by two-step acid leaching gradient separation.

EXAMPLES

Example 1

The cerium-based rare-earth polishing powder waste is proceeded as follows:

(1) Ball milling pretreatment: the cerium-based rare-earth polishing powder waste, whose total mass fraction of rare-earth oxides is 15%, is ball-milled to a particle size of 160 mesh to obtain ball-milled waste. The phase structure of the cerium-based rare-earth polishing powder waste is analyzed with X-ray diffractometer (XRD), and the result shows that the rare-earth components in the cerium-based rare-earth polishing powder waste are mainly LaOF, $La_2O_3$, and $CeO_2$;

(2) First acid leaching: put the ball milled waste obtained in step (1) into a container and add hydrochloric acid solution for the first acid leaching. Keep heating and stirring during the first acid leaching process. The molar concentration of the acid solution is 5 mol/L, the solid-liquid ratio of ball milling waste and acid solution is 1 kg:8 L, the leaching temperature is 80° C., the leaching time is 2 hours, and the stirring speed is 500 rpm. Separate the solid and the liquid after the first acid leaching reaction to obtain leaching residue and leaching liquor 1.

(3) Alkali roasting: mix the leaching residue obtained in step (2) with $Na_2O_2$ and roast the mixture to obtain roasted mixture. The mass ratio of leaching residue and alkali is 1:1, the roasting temperature is 650° C., and the roasting time is 1.5 hours;

(4) Water leaching: put the roasted mixture obtained in step (3) in water. The solid-liquid ratio of the roasted mixture to water is 1 kg:9 L, the water leaching temperature is 80° C., the water leaching time is 2 hours, and the stirring speed is 400 rpm. After the water leaching, separate the solid from the liquid, and the water leaching residue is obtained by filtration;

(5) Second acid leaching: mix the water leaching residue obtained in step (4) with nitric acid solution to carry out secondary acid leaching reaction. The molar concentration of the acid solution for the second acid leaching is 8 mol/L, the solid-liquid ratio of the water leaching residue and the acid solution is 1 kg:6 L, the leaching temperature is 70° C., the stirring speed is 300 rpm, and the leaching time is 3 hours. Separate the solid from the liquid after the second acid leaching, filter, and wash the product with hydrochloric acid resolution with a mass concentration of 2% for 8 times to obtain $CeO_2$ product and leaching liquor 2.

(6) Precipitation of rare-earth with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 5:1. Stir and add ammonia whose mass percentage concentration ratio is 25%, until the pH value of the solution reaches 1.8, and precipitate at 90° C. for 3 hours. Filtrate to obtain rare-earth oxalate;

(7) Calcination: the rare-earth oxalate obtained in step (6) is calcined in a muffle furnace at 950° C. for 0.5 hour to obtain mixed rare-earth oxide product.

The total recovery rate of rare-earth La and Ce in cerium-based rare-earth polishing powder waste is 97.5%.

Example 2

The cerium-based rare-earth polishing powder waste is proceeded as follows:

(1) Ball milling pretreatment: the cerium-based rare-earth polishing powder waste, whose total mass fraction of rare-earth oxides is 30%, is ball-milled to a particle size of 200 mesh to obtain ball-milled waste. The phase structure of the cerium-based rare-earth polishing powder waste is analyzed with X-ray diffractometer (XRD), and the result shows that the rare-earth components in the cerium-based rare-earth polishing powder waste are mainly LaOF, $La_2O_3$, and $CeO_2$;

(2) First acid leaching: put the ball milled waste obtained in step (1) into a container and add hydrochloric acid solution for the first acid leaching. Keep heating and stirring during the first acid leaching process. The molar concentration of the acid solution is 8 mol/L, the solid-liquid ratio of ball milling waste and acid solution is 1 kg:4 L, the leaching temperature is 75° C., the leaching time is 2 hours, and the stirring speed is 300 rpm. Separate the solid and the liquid after the first acid leaching reaction to obtain leaching residue and leaching liquor 1.

(3) Alkali roasting: mix the leaching residue obtained in step (2) with $K_2O_2$ and roast the mixture to obtain roasted mixture. The mass ratio of leaching residue and alkali is 1:1.8, the roasting temperature is 650° C., and the roasting time is 1 hours;

(4) Water leaching: put the roasted mixture obtained in step (3) in water. The solid-liquid ratio of the roasted mixture to water is 1 kg:4 L, the water leaching temperature is 90° C., the water leaching time is 3 hours, and the stirring speed is 500 rpm. After the water leaching, separate the solid from the liquid, and the water leaching residue is obtained by filtration;

(5) Second acid leaching: mix the water leaching residue obtained in step (4) with nitric acid solution to carry out secondary acid leaching reaction. The molar concentration of the acid solution for the second acid leaching is 7 mol/L, the solid-liquid ratio of the water leaching residue and the acid solution is 1 kg:4.5 L, the leaching temperature is 75° C., the stirring speed is 400 rpm, and the leaching time is 2.5 hours. Separate the solid from the liquid after the second acid leaching, filter, and wash the product with hydrochloric acid resolution with a mass concentration of 5% for 4 times to obtain $CeO_2$ product and leaching liquor 2.

(6) Precipitation of rare-earth with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 3:1. Stir and add ammonia whose mass percentage concentration ratio is 25%, until the pH value of the solution reaches 2.0, and precipitate at 90° C. for 2.5 hours. Filtrate to obtain rare-earth oxalate;

(7) Calcination: the rare-earth oxalate obtained in step (6) is calcined in a muffle furnace at 950° C. for 1 hour to obtain mixed rare-earth oxide product.

The total recovery rate of rare-earth La and Ce in cerium-based rare-earth polishing powder waste is 98.6%.

Example 3

The cerium-based rare-earth polishing powder waste is proceeded as follows:

(1) Ball milling pretreatment: the cerium-based rare-earth polishing powder waste, whose total mass fraction of rare-earth oxides is 30%, is ball-milled to a particle size of 400 mesh to obtain ball-milled waste. The phase structure of the cerium-based rare-earth polishing powder waste is analyzed with X-ray diffractometer (XRD), and the result shows that the rare-earth components in the cerium-based rare-earth polishing powder waste are mainly LaOF, $La_2O_3$, and $CeO_2$;

(2) First acid leaching: put the ball milled waste obtained in step (1) into a container and add hydrochloric acid solution for the first acid leaching. Keep heating and stirring during the first acid leaching process. The molar concentration of the acid solution is 6 mol/L, the solid-liquid ratio of ball milling waste and acid solution is 1 kg:6.5 L, the leaching temperature is 80° C., the leaching time is 1.5 hours, and the stirring speed is 400 rpm. Separate the solid and the liquid after the first acid leaching reaction to obtain leaching residue and leaching liquor 1.

(3) Alkali roasting: mix the leaching residue obtained in step (2) with $Na_2O_2$ and roast the mixture to obtain roasted mixture. The mass ratio of leaching residue and alkali is 1:2.5, the roasting temperature is 550° C., and the roasting time is 1 hours;

(4) Water leaching: put the roasted mixture obtained in step (3) in water. The solid-liquid ratio of the roasted mixture to water is 1 kg:8 L, the water leaching temperature is 90° C., the water leaching time is 2.5 hours, and the stirring speed is 400 rpm. After the water leaching, separate the solid from the liquid, and the water leaching residue is obtained by filtration;

(5) Second acid leaching: mix the water leaching residue obtained in step (4) with nitric acid solution to carry out secondary acid leaching reaction. The molar concentration of the acid solution for the second acid leaching is 7 mol/L, the solid-liquid ratio of the water leaching residue and the acid solution is 1 kg:5 L, the leaching temperature is 75° C., the stirring speed is 500 rpm, and the leaching time is 2.5 hours. Separate the solid from the liquid after the second acid leaching, filter, and wash the product with hydrochloric acid resolution with a mass concentration of 4% for 6 times to obtain $CeO_2$ product and leaching liquor 2.

(6) Precipitation of rare-earth with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 4:1. Stir and add ammonia whose mass percentage concentration ratio is 25%, until the pH value of the solution reaches 1.9, and precipitate at 90° C. for 3 hours. Filtrate to obtain rare-earth oxalate;

(7) Calcination: the rare-earth oxalate obtained in step (6) is calcined in a muffle furnace at 950° C. for 0.75 hour to obtain mixed rare-earth oxide product.

The total recovery rate of rare-earth La and Ce in cerium-based rare-earth polishing powder waste is 98.2%.

Example 4

The cerium-based rare-earth polishing powder waste is proceeded as follows:

(1) Ball milling pretreatment: the cerium-based rare-earth polishing powder waste, whose total mass fraction of rare-earth oxides is 40%, is ball-milled to a particle size of 400 mesh to obtain ball-milled waste. The phase structure of the cerium-based rare-earth polishing powder waste is analyzed with X-ray diffractometer (XRD), and the result shows that the rare-earth components in the cerium-based rare-earth polishing powder waste are mainly LaOF, $La_2O_3$, and $CeO_2$;

(2) First acid leaching: put the ball milled waste obtained in step (1) into a container and add hydrochloric acid solution for the first acid leaching. Keep heating and stirring during the first acid leaching process. The molar concentration of the acid solution is 8 mol/L, the solid-liquid ratio of ball milling waste and acid solution is 1 kg:8 L, the leaching temperature is 80° C., the leaching time is 2 hours, and the stirring speed is 300 rpm. Separate the solid and the liquid after the first acid leaching reaction to obtain leaching residue and leaching liquor 1.

(3) Alkali roasting: mix the leaching residue obtained in step (2) with $K_2O_2$ and roast the mixture to obtain roasted mixture. The mass ratio of leaching residue and alkali is 1:5, the roasting temperature is 650° C., and the roasting time is 0.5 hours;

(4) Water leaching: put the roasted mixture obtained in step (3) in water. The solid-liquid ratio of the roasted mixture to water is 1 kg:6 L, the water leaching temperature is 85° C., the water leaching time is 3 hours, and the stirring speed is 500 rpm. After the water leaching, separate the solid from the liquid, and the water leaching residue is obtained by filtration;

(5) Second acid leaching: mix the water leaching residue obtained in step (4) with nitric acid solution to carry out secondary acid leaching reaction. The molar concentration of the acid solution for the second acid leaching is 6 mol/L, the solid-liquid ratio of the water leaching residue and the acid solution is 1 kg:6 L, the leaching temperature is 80° C., the stirring speed is 400 rpm, and the leaching time is 2.5 hours. Separate the solid from the liquid after the second acid leaching, filter, and wash the product with hydrochloric acid resolution with a mass concentration of 2.5% for 6 times to obtain $CeO_2$ product and leaching liquor 2.

(6) Precipitation of rare-earth with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 5:1. Stir and add ammonia whose mass percentage concentration ratio is 25%, until the pH value of the solution reaches 1.8, and precipitate at 85° C. for 3 hours. Filtrate to obtain rare-earth oxalate;

(7) Calcination: the rare-earth oxalate obtained in step (6) is calcined in a muffle furnace at 950° C. for 1 hour to obtain mixed rare-earth oxide product.

The total recovery rate of rare-earth La and Ce in cerium-based rare-earth polishing powder waste is 98.3%.

Example 5

The cerium-based rare-earth polishing powder waste is proceeded as follows:

(1) Ball milling pretreatment: the cerium-based rare-earth polishing powder waste, whose total mass fraction of rare-earth oxides is 45%, is ball-milled to a particle size of 200 mesh to obtain ball-milled waste. The phase structure of the cerium-based rare-earth polishing powder waste is analyzed with X-ray diffractometer (XRD), and the result shows that the rare-earth components in the cerium-based rare-earth polishing powder waste are mainly LaOF, $La_2O_3$, and $CeO_2$;

(2) First acid leaching: put the ball milled waste obtained in step (1) into a container and add hydrochloric acid solution for the first acid leaching. Keep heating and stirring during the first acid leaching process. The molar concentration of the acid solution is 7 mol/L, the solid-liquid ratio of ball milling waste and acid solution is 1 kg:6 L, the leaching temperature is 80° C., the leaching time is 1.5 hours, and the stirring speed is 400 rpm. Separate the solid and the liquid after the first acid leaching reaction to obtain leaching residue and leaching liquor 1.

(3) Alkali roasting: mix the leaching residue obtained in step (2) with $Na_2O_2$ and roast the mixture to obtain roasted mixture. The mass ratio of leaching residue and alkali is 1:2.1, the roasting temperature is 550° C., and the roasting time is 1.5 hours;

(4) Water leaching: put the roasted mixture obtained in step (3) in water. The solid-liquid ratio of the roasted mixture to water is 1 kg:8 L, the water leaching temperature is 85° C., the water leaching time is 2 hours, and the stirring speed is 300 rpm. After the water leaching, separate the solid from the liquid, and the water leaching residue is obtained by filtration;

(5) Second acid leaching: mix the water leaching residue obtained in step (4) with nitric acid solution to carry out secondary acid leaching reaction. The molar concentration of the acid solution for the second acid leaching is 5 mol/L, the solid-liquid ratio of the water leaching residue and the acid solution is 1 kg:5 L, the leaching temperature is 80° C., the stirring speed is 400 rpm, and the leaching time is 3 hours. Separate the solid from the liquid after the second acid leaching, filter, and wash the product with hydrochloric acid resolution with a mass concentration of 4% for 5 times to obtain $CeO_2$ product and leaching liquor 2.

(6) Precipitation of rare-earth with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 5:1. Stir and add ammonia whose mass percentage concentration ratio is 25%, until the pH value of the solution reaches 1.9, and precipitate at 90° C. for 2.5 hours. Filtrate to obtain rare-earth oxalate;

(7) Calcination: the rare-earth oxalate obtained in step (6) is calcined in a muffle furnace at 950° C. for 0.75 hour to obtain mixed rare-earth oxide product.

The total recovery rate of rare-earth La and Ce in cerium-based rare-earth polishing powder waste is 97.1%.

Example 6

The cerium-based rare-earth polishing powder waste is proceeded as follows:

(1) Ball milling pretreatment: the cerium-based rare-earth polishing powder waste, whose total mass fraction of rare-earth oxides is 60%, is ball-milled to a particle size of 200 mesh to obtain ball-milled waste. The phase structure of the cerium-based rare-earth polishing powder waste is analyzed with X-ray diffractometer (XRD), and the result shows that the rare-earth components in the cerium-based rare-earth polishing powder waste are mainly LaOF, $La_2O_3$, and $CeO_2$;

(2) First acid leaching: put the ball milled waste obtained in step (1) into a container and add hydrochloric acid solution for the first acid leaching. Keep heating and stirring during the first acid leaching process. The molar concentration of the acid solution is 6 mol/L, the solid-liquid ratio of ball milling waste and acid solution is 1 kg:8 L, the leaching temperature is 75° C., the leaching time is 1.5 hours, and the stirring speed is 450 rpm. Separate the solid and the liquid after the first acid leaching reaction to obtain leaching residue and leaching liquor 1.

(3) Alkali roasting: mix the leaching residue obtained in step (2) with $K_2O_2$ and roast the mixture to obtain roasted mixture. The mass ratio of leaching residue and alkali is 1:1, the roasting temperature is 450° C., and the roasting time is 0.5 hours;

(4) Water leaching: put the roasted mixture obtained in step (3) in water. The solid-liquid ratio of the roasted mixture to water is 1 kg:9 L, the water leaching temperature is 80° C., the water leaching time is 2 hours, and the stirring speed is 500 rpm. After the water leaching, separate the solid from the liquid, and the water leaching residue is obtained by filtration;

(5) Second acid leaching: mix the water leaching residue obtained in step (4) with nitric acid solution to carry out secondary acid leaching reaction. The molar concentration of the acid solution for the second acid leaching is 6.5 mol/L, the solid-liquid ratio of the water leaching residue and the acid solution is 1 kg:4 L, the leaching temperature is 75° C., the stirring speed is 400 rpm, and the leaching time is 2.5 hours. Separate the solid from the liquid after the second acid leaching, filter, and wash the product with hydrochloric acid resolution with a mass concentration of 5% for 5 times to obtain $CeO_2$ product and leaching liquor 2.

(6) Precipitation of rare-earth with oxalic acid: mix the leaching liquor 1 obtained in step (2) and the leaching liquor 2 obtained in step (5) to obtain mixed solution, and add oxalic acid solution with a mass concentration of 100 g/L to the mixed solution to precipitate rare-earths. The volume ratio of the mixed solution and the oxalic acid solution is 4:1. Stir and add ammonia whose mass percentage concentration ratio is 25%, until the pH value of the solution reaches 1.9, and precipitate at 85° C. for 2.5 hours. Filtrate to obtain rare-earth oxalate;

(7) Calcination: the rare-earth oxalate obtained in step (6) is calcined in a muffle furnace at 950° C. for 1 hour to obtain mixed rare-earth oxide product.

The total recovery rate of rare-earth La and Ce in cerium-based rare-earth polishing powder waste is 97.4%.

What is claimed is:

1. A method of separating and recycling rare-earth in cerium-based rare-earth polishing powder waste by two-step acid leaching, comprising the following specific steps:

(1) Ball milling pretreatment: ball-mill the cerium-based rare-earth polishing powder waste to a particle size below 160 mesh to obtain ball-milled waste;

(2) First acid leaching: put the ball-milled waste obtained in step (1) into a container and add a first acid solution for a first acid leaching reaction, keep heating and stirring during the first acid leaching reaction, separate solid and liquid after the first acid leaching reaction to obtain leaching residue and leaching liquor 1, wherein a molar concentration of the first acid solution is 5-8 mol/L, a solid-liquid ratio of the ball-milled waste to the first acid solution is 1:4-1:8 kg/L, leaching temperature is 70-80° C., and leaching time is 1-2 hours;

(3) Alkali roasting: mix the leaching residue obtained in step (2) with alkali to obtain a mixture and roast the mixture to obtain a roasted mixture, wherein a mass ratio of the leaching residue to alkali is 1:1-1:3, roasting temperature is 450-650° C., and roasting time is 0.5-1.5 hours;

(4) Water leaching: put the roasted mixture obtained in step (3) in water to conduct water leaching, a solid-liquid ratio of the roasted mixture to water is 1:4-1:9 kg/L, water leaching temperature is 80-90° C., water leaching time is 2-3 hours, and stirring speed is 300-500 rpm, after the water leaching is completed, separate solid from liquid, and water leaching residue is obtained by filtration;

(5) Second acid leaching: mix the water leaching residue obtained in step (4) with a second acid solution to carry out a second acid leaching reaction, separate solid from liquid after the second acid leaching reaction is completed, and conduct filtration to obtain $CeO_2$ product and leaching liquor 2, wherein a molar concentration of the second acid solution is 5-8 mol/L, a solid-liquid ratio of the water leaching residue to the second acid solution is 1:2.5-1:6 kg/L, leaching temperature is 70-80° C., and leaching time is 2-3 hours;

(6) Precipitation of rare-earths with oxalic acid: mix the leaching liquor 1 obtained in step (2) and the leaching liquor 2 obtained in step (5) to obtain a mixed solution, and add an oxalic acid solution with a mass concentration of 100 g/L to the mixed solution to precipitate rare earths, a volume ratio of the mixed solution to the oxalic acid solution is 5:1-3:1, stir and add ammonia with a mass percentage concentration of 25%, until a pH value of the mixed solution reaches 1.8-2.0, and precipitate at 80-90° C. for 2-3 hours, conduct filtration to obtain rare-earth oxalate;

(7) Calcination: calcine the rare-earth oxalate obtained in step (6) in a muffle furnace at 950° C. for 0.5-1 hour to obtain rare-earth oxide product; wherein:

in step (2), the first acid solution is hydrochloric acid solution or nitric acid solution;

in step (2), a stirring speed during the first acid leaching reaction is 300-500 rpm;

in step (3), the alkali is $Na_2O_2$ or $K_2O_2$;

in step (5), the second acid solution is hydrochloric acid solution or nitric acid solution.

2. The method according to claim 1, wherein, in step (5), a stirring speed during the second acid leaching reaction is 300-500 rpm.

3. The method according to claim 1, wherein the $CeO_2$ product obtained in step (5) is washed 4-8 times with a hydrochloric acid solution to remove impurities, a mass concentration of the hydrochloric acid solution is 2-5%.

4. The method according to claim 1, wherein the leaching liquor 1 obtained in step (2) is evaporated and concentrated until a molar concentration of HCl or HNO in the leaching liquor 1 reaches 5-8 mol/L to obtain a concentrated leaching liquor 1, the concentrated leaching liquor 1 is then incorporated into the second acid leaching reaction of step (5) to partially or completely replace the second acid solution.

* * * * *